United States Patent [19]

Sakamura

[11] 4,393,685

[45] Jul. 19, 1983

[54] TOOL ATTACHING DEVICE FOR PRESSES

[76] Inventor: Yoshikazu Sakamura, 56, Kitamomodani-Cho, Minami-Ku, Osaka-Shi, Japan

[21] Appl. No.: 237,409

[22] Filed: Feb. 23, 1981

[51] Int. Cl.[3] ..... B21J 13/02

[52] U.S. Cl. ..... 72/481; 83/698

[58] Field of Search ..... 72/462, 481, 446, 455, 72/447; 10/26, 22; 83/698; 279/29, 30

[56] References Cited

U.S. PATENT DOCUMENTS

| | | | |
|---|---|---|---|
| 1,910,296 | 5/1933 | King | 83/698 |
| 2,420,146 | 5/1947 | Mueller | 83/698 |
| 3,834,218 | 9/1974 | Kralowetz | 72/462 |
| 4,184,358 | 1/1980 | Gorlitsin | 72/462 |

FOREIGN PATENT DOCUMENTS

| | | | |
|---|---|---|---|
| 620485 | 10/1935 | Fed. Rep. of Germany | 83/698 |
| 197667 | 5/1958 | Fed. Rep. of Germany | 83/698 |
| 2902164 | 8/1979 | Fed. Rep. of Germany | 72/481 |
| 965082 | 7/1964 | United Kingdom | 72/481 |
| 369968 | 2/1973 | U.S.S.R. | 72/481 |
| 381446 | 5/1973 | U.S.S.R. | 72/481 |
| 676473 | 7/1979 | U.S.S.R. | 72/481 |

*Primary Examiner*—Lowell A. Larson

*Attorney, Agent, or Firm*—Wenderoth, Lind & Ponack

[57] ABSTRACT

A tool holder for withdrawably holding a tool inserted therein is provided with an eccentric pressing member which is openly positioned for the insertion of the tool into the holder and bitingly engageable with the tool against the withdrawal of the tool. The eccentric pressing member is biased toward the direction of the bite and has an unlocking lever provided with a power pusher.

4 Claims, 8 Drawing Figures

TOOL ATTACHING DEVICE FOR PRESSES

BACKGROUND OF THE INVENTION

The present invention relates to a tool attaching device for use in presses including a multiplicity of sets of punches and dies for producing bolts, nuts or like metal articles by a continuous operation, and more particularly to a device by which tools can be replaced easily and quickly in such manner that when a punch, die or like tool is broken or worn, the tool is released and can easily withdrawn from the tool holder merely by a single stroke of a hydraulic or pneumatic power pusher, and a new tool can be set in place simply by inserting it into the holder.

With conventional tool attaching devices, the tool is usually fastened to a tool holder by tightening a bolt, but in the case where a multiplicity of tools are used as when arranged in a row, it is very cumbersome and requires much labor to replace the tools every time such a tool is broken or worn. Especially punches and dies, which are subjected to a high impact and therefore tightly lodged in place, are sometimes difficult to remove and have the drawback of resulting in a reduced work efficiency.

SUMMARY OF THE INVENTION

An object of the present invention is to provide a device which comprises an eccentric pressing member bitingly engageable with the peripheral surface of a punch, die or like tool inserted in a holder and by which the tool can be quickly replaced by a new one, the pressing member being movable in a direction opposite to the direction of the bite by a single stroke of a hydraulic, pneumatic or like power pusher to render the old tool easily withdrawable from the holder, the device being so adapted that the new tool can be firmly set in place simply by pushing it into the holder.

Another object of the invention is to provide a device of the type described in which the eccentric pressing member can be manually moved by a lever even when the pusher malfunctions, so that the tool can be replaced similarly easily and reliably.

Still another object of the invention is to provide a device of the type described which is simple in construction, inexpensive to make, usable for a press of any type and operable free of any trouble.

DESCRIPTION OF THE PREFERRED EMBODIMENTS

Figure 1:
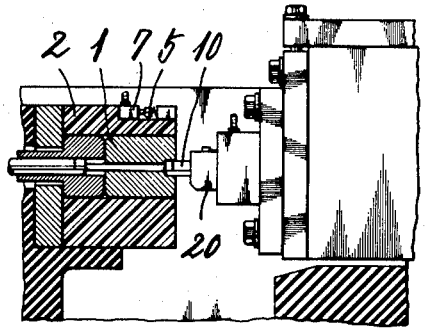
FIG. 1 is a side elevation partly in section showing first and second embodiments of the invention holding opposite ends of a die.
Figure 4:
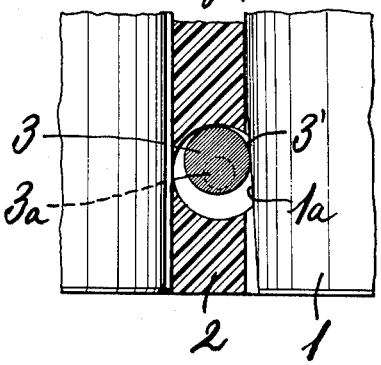
FIG. 4 is a view in section taken along the line IV—IV in FIG. 2.
Figure 2:
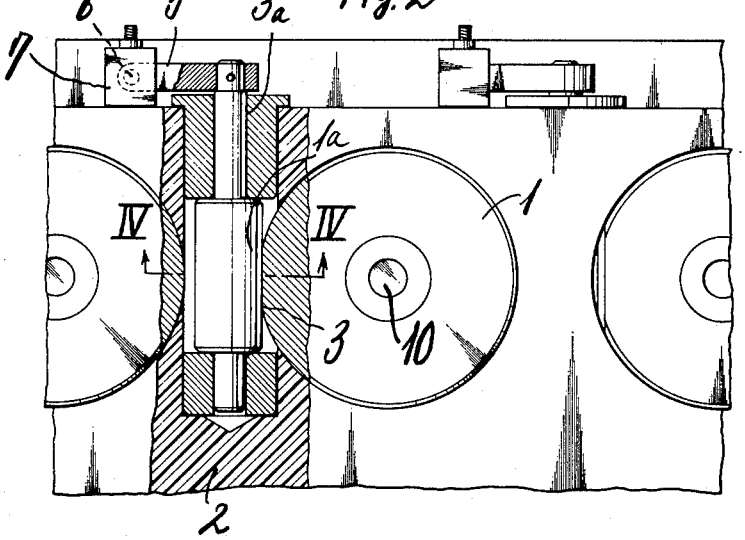
FIG. 2 is an enlarged front view of the first embodiment shown in FIG. 1 showing a portion of the device of the invention for holding a die in which a punch is held.
Figure 3:
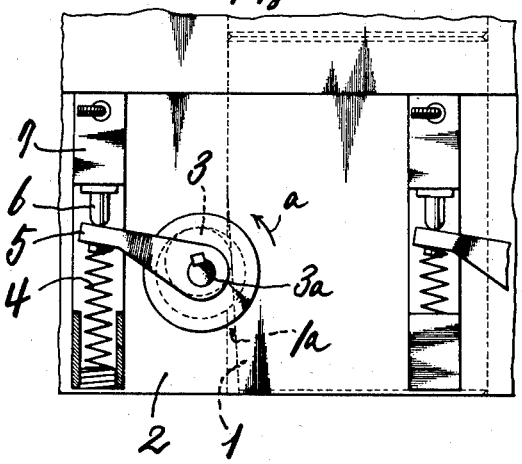
FIG. 3 is a plan view of the same.

Referring to the left hand portion of FIG. 1 and FIGS. 2–4, in a first embodiment of the invention, holder 2 for holding a die 1, which in turn holds a punch like tool 10, withdrawably inserted therein is provided with a pivotable eccentric pressing member 3 in contact with the outer peripheral surface of the die 1 for preventing the tool from slipping off. The pressing member 3 is so positioned as to be openly positioned for the insertion of the die 1 into the holder 2 but bitingly engageable with the die at all times against the withdrawal of the die. The pressing member 3 is biased in the direction of the bite by a spring 4 through an unlocking lever 5 which is attached to one end of a support rod 3*a* of the pressing member 3 as seen in FIGS. 2 and 3. A power pusher 6 for operating the lever 5 is fitted in a cylinder 7 so as to be hydraulically or pneumatically extensible like a piston and has a forward end bearing against the free end of the lever 5.

Figure 5:
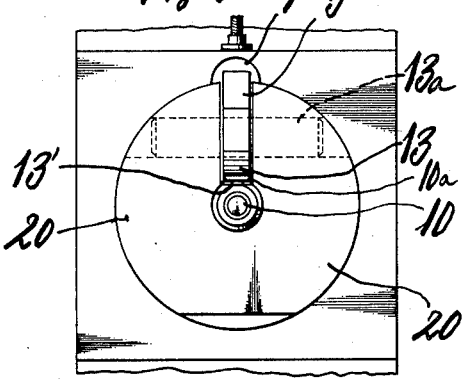
FIG. 5 is an enlarged front view showing the second embodiment of the device of the invention for directly holding a punch.
Figure 6:
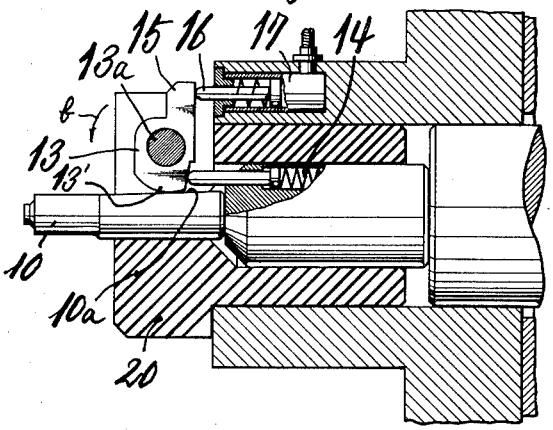
FIG. 6 is a side elevation in vertical section showing the same.

In a second embodiment shown in the right-hand side of FIG. 1 and FIGS. 5 and 6, the punch or other tool 10 is held by a holder 20 and is directly engaged by a pressing member 13 formed integrally with unlocking lever 15 and having a support rod 13 and an eccentric portion 13'. Pressing member 13 is biased by a spring 14 engaging eccentric portion 13'. A cylinder 17 houses one end of a hydraulically or pneumatically driven power pusher 16, the other end of which engages a free end of locking lever 15.

In accordance with the above described embodiments, the punch or die can be replaced by a new one in a similar manner. First, the pusher 6 or 16 is forced out by applying pneumatic or hydraulic pressure to the cylinder 7 or 17. The lever 5 or 15 pushed by the pusher 6 or 16 turns the eccentric pressing member 3 or 13 about the axis of the support rod 3*a* in the direction of an arrow a in FIG. 3 or arrow b in FIG. 6, whereby the eccentric portion 3' or 13' of the pressing member 3 or 13 which portion has been in biting engagement with the peripheral surface of the die 1 or punch 10, is moved out of engagement with the peripheral surface, thereby releasing the die 1 or punch 10 so that the same can be forwardly withdrawn from the holder 2 or 20. The die or punch is then pulled out manually.

To set a new punch or die in place, the tool is manually pushed into the bore of the holder 2 or 20 from its front end, whereby the tool is installed in place while forcing the pressing member 3 or 13 in a direction opposite to the direction of bite against the force of the spring 4. Upon the installation of the die 1 or punch 10 in place, the spring 4 or 14 turns the pressing member 3 or 13 into biting engagement with the peripheral surface of the die 1 or punch 10 which is therefore prevented from slipping off in the forward direction.

Figure 8:
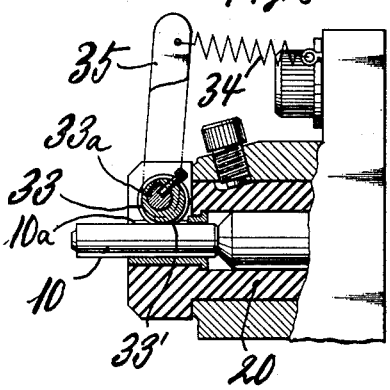
FIG. 8 is a side elevation in vertical section showing a fourth embodiment of the invention provided for directly holding a punch.
Figure 7:
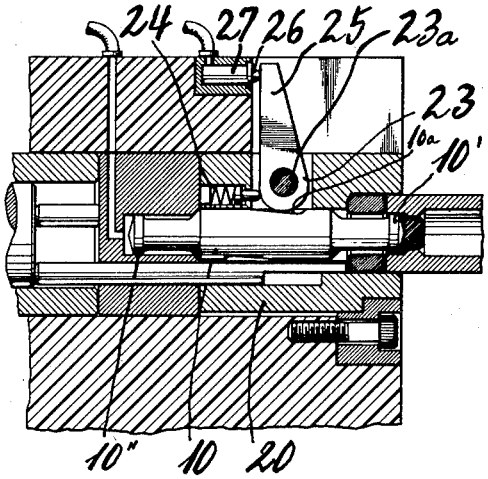
FIG. 7 is a side elevation in vertical section showing a third embodiment of the invention as provided for directly holding a punch.

FIG. 7 shows another embodiment for holding a punch 10 having punch portions 10' and 10'' at its opposite ends, one of which is alternatively usable in a reversed position. FIG. 8 shows an unlocking lever 35 which is manually movable without using any power pusher. Other elements of the embodiments shown in FIG. 7 and FIG. 8 similar to those shown in FIGS. 1–3 are identified by numerals respectively 20 and 30 greater than the corresponding numerals in FIGS. 1–3.

What is claimed is:

1. A device for attaching a tool to a press, comprising:

(1) means for withdrawingly holding a tool therein, the tool inserted therein in a first direction;

(2) means, including a pressing member having an eccentric portion for preventing the tool when held in said holding means from slipping out of said holding means while in contact with the peripheral surface of the tool, pivotally mounted on said holding means and openly positioned for pivotal movement in a circumferential direction during insertion of the tool, for engaging the tool at said eccentric portion in biting contact therewith when the tool is held in said holding means, so as to exert a force thereon in a second direction opposite said first direction, said pressing member being provided with an unlocking lever including an elongated member;

(3) spring means for elastically biasing said pressing member in said second direction; and (4) a fluid driven power pusher engagable with said elongated member for pivoting said unlocking lever in said circumferential direction against the bias of said spring means to pivot said pressing member to pivot said eccentric portion in said first direction so as to disengage said eccentric portion from the tool so that the tool can be withdrawn from said holder in said second direction; said elongated member being disengagable from said power pusher, whereby said pressing member can be pivoted in said circumferential direction by manually pivoting said elongated member to disengage said eccentric portion from the tool.

2. A device as in claim 1, wherein said spring means engages said unlocking lever to bias said unlocking lever in said circumferential direction.

3. A device as in claim 2 wherein said spring means comprises a spring mounted co-linearly with said pivoting means.

4. A device as in claim 1, wherein said spring means engages said eccentric portion to bias said eccentric portion in said second direction.

* * * * *